US008538581B2

(12) United States Patent
Kuehnrich et al.

(10) Patent No.: US 8,538,581 B2
(45) Date of Patent: Sep. 17, 2013

(54) ARTICLE VENDING MACHINE AND METHOD FOR AUTHENTICATING RECEIVED ARTICLES

(75) Inventors: Franz Kuehnrich, Bartlett, IL (US); Jonathan Palmer, Chicago, IL (US)

(73) Assignee: Redbox Automated Retail, LLC, Oakbrook Terrace, IL (US)

( * ) Notice: Subject to any disclaimer, the term of this patent is extended or adjusted under 35 U.S.C. 154(b) by 0 days.

(21) Appl. No.: 12/876,046

(22) Filed: Sep. 3, 2010

(65) Prior Publication Data

US 2012/0059509 A1 Mar. 8, 2012

(51) Int. Cl.
*G07F 17/00* (2006.01)

(52) U.S. Cl.
USPC ..... 700/237; 700/236; 700/232; 700/244; 700/225

(58) Field of Classification Search
USPC ..... 700/232, 231, 236, 237, 244, 225
See application file for complete search history.

(56) References Cited

U.S. PATENT DOCUMENTS

| | | | |
|---|---|---|---|
| 1,901,243 | A | 3/1933 | Horwitt |
| 2,098,697 | A | 11/1937 | Vanderput |
| 2,549,624 | A | 4/1951 | Moore |
| 2,559,599 | A | 7/1951 | Crump et al. |
| 2,562,293 | A | 7/1951 | Bourquin |
| 3,267,436 | A | 8/1966 | Norman et al. |
| 3,379,295 | A | 4/1968 | Clement |
| 3,529,155 | A | 9/1970 | Hansen |
| 3,622,995 | A | 11/1971 | Dilks et al. |
| 3,648,241 | A | 3/1972 | Naito et al. |
| 3,824,544 | A | 7/1974 | Simjian |
| 3,826,344 | A | 7/1974 | Wahlberg |
| 3,831,807 | A | 8/1974 | Deaton |
| 3,946,220 | A | 3/1976 | Brobeck et al. |
| 3,964,577 | A | 6/1976 | Bengtsson |
| 4,043,483 | A | 8/1977 | Gore et al. |
| 4,073,368 | A | 2/1978 | Mustapick |
| 4,300,040 | A | 11/1981 | Gould et al. |

(Continued)

FOREIGN PATENT DOCUMENTS

| | | |
|---|---|---|
| CA | 2302753 | 5/1999 |
| CA | 1236546 | 1/2000 |

(Continued)

OTHER PUBLICATIONS

Patent Cooperation Treaty International Search Report for Application PCT/US2005/12563 mailed Aug. 10, 2005.

(Continued)

*Primary Examiner* — Michael K Collins
(74) *Attorney, Agent, or Firm* — James P. Muraff; Neal, Gerber & Eisenberg LLP

(57) ABSTRACT

An article dispensing machine, system and method for authenticating an article returned to the article dispensing machine and an article for use in such a machine and system. The article dispensing machine comprises an infrared light for illuminating the surface of the returned article, an image capture device for capturing the image of an authentication code on the returned article, and a processor for comparing the captured image to a master authentication code. The returned article comprises the authentication code printed in a carbon-containing ink and a substantially carbon free ink portion printed overtop of and at least partially concealing the authentication code, such that the authentication code is not visible in white light, but becomes visible when exposed to infrared light.

19 Claims, 7 Drawing Sheets

(56) References Cited

U.S. PATENT DOCUMENTS

| | | | |
|---|---|---|---|
| 4,306,219 | A | 12/1981 | Main et al. |
| 4,348,551 | A | 9/1982 | Nakatani et al. |
| 4,369,422 | A | 1/1983 | Rasmussen et al. |
| 4,385,366 | A | 5/1983 | Housey |
| 4,388,689 | A | 6/1983 | Hayman et al. |
| 4,396,985 | A | 8/1983 | Ohara |
| 4,414,467 | A | 11/1983 | Gould et al. |
| 4,415,065 | A | 11/1983 | Sandstedt |
| 4,449,186 | A | 5/1984 | Kelly et al. |
| 4,458,802 | A | 7/1984 | Maciver et al. |
| 4,519,522 | A | 5/1985 | McElwee |
| 4,530,067 | A | 7/1985 | Dorr |
| 4,547,851 | A | 10/1985 | Kurland |
| 4,553,222 | A | 11/1985 | Kurland et al. |
| 4,567,359 | A | 1/1986 | Lockwood |
| 4,569,421 | A | 2/1986 | Sandstedt |
| RE32,115 | E | 4/1986 | Lockwood et al. |
| 4,598,810 | A | 7/1986 | Shore et al. |
| 4,649,481 | A | 3/1987 | Takahashi |
| 4,650,977 | A | 3/1987 | Couch |
| 4,668,150 | A | 5/1987 | Blumberg |
| 4,669,596 | A | 6/1987 | Capers et al. |
| 4,675,515 | A | 6/1987 | Lucero |
| 4,706,794 | A | 11/1987 | Awane et al. |
| 4,722,053 | A | 1/1988 | Dubno |
| 4,723,212 | A | 2/1988 | Mindrum et al. |
| 4,734,005 | A | 3/1988 | Blumberg |
| 4,766,548 | A | 8/1988 | Cedrone et al. |
| 4,767,917 | A | 8/1988 | Ushikubo |
| 4,775,935 | A | 10/1988 | Yourick |
| 4,778,983 | A | 10/1988 | Ushikubo |
| 4,789,045 | A | 12/1988 | Pugh |
| 4,789,054 | A | 12/1988 | Shore |
| 4,797,818 | A | 1/1989 | Cotter |
| 4,812,629 | A | 3/1989 | O'Neil et al. |
| 4,812,985 | A | 3/1989 | Hambrick et al. |
| 4,814,592 | A | 3/1989 | Bradt et al. |
| 4,814,985 | A | 3/1989 | Swistak |
| 4,821,917 | A | 4/1989 | Brown |
| 4,825,045 | A | 4/1989 | Humble |
| 4,839,505 | A | 6/1989 | Bradt et al. |
| 4,839,507 | A | 6/1989 | May |
| 4,847,764 | A | 7/1989 | Halvorson |
| 4,858,743 | A | 8/1989 | Paraskevakos et al. |
| 4,860,876 | A | 8/1989 | Moore et al. |
| 4,866,661 | A | 9/1989 | de Prins |
| 4,882,475 | A | 11/1989 | Miller et al. |
| 4,893,705 | A | 1/1990 | Brown |
| 4,893,727 | A | 1/1990 | Near |
| 4,896,024 | A | 1/1990 | Morello et al. |
| 4,903,815 | A | 2/1990 | Hirschfeld et al. |
| 4,915,205 | A | 4/1990 | Reid et al. |
| D308,052 | S | 5/1990 | Darden et al. |
| 4,941,841 | A | 7/1990 | Darden et al. |
| 4,945,428 | A | 7/1990 | Waldo |
| 4,947,028 | A | 8/1990 | Gorog |
| 4,959,686 | A | 9/1990 | Spallone et al. |
| 4,967,403 | A | 10/1990 | Ogawa et al. |
| 4,967,906 | A | 11/1990 | Morello et al. |
| 4,982,346 | A | 1/1991 | Girouard et al. |
| 4,991,739 | A | 2/1991 | Levasseur |
| 4,995,498 | A | 2/1991 | Menke |
| 5,007,518 | A | 4/1991 | Crooks et al. |
| 5,012,077 | A | 4/1991 | Takano |
| 5,013,897 | A | 5/1991 | Harman et al. |
| 5,019,699 | A | 5/1991 | Koenck |
| 5,020,958 | A | 6/1991 | Tuttobene |
| 5,028,766 | A | 7/1991 | Shah |
| 5,042,686 | A | 8/1991 | Stucki |
| 5,077,462 | A | 12/1991 | Newell |
| 5,077,607 | A | 12/1991 | Johnson et al. |
| 5,085,308 | A | 2/1992 | Wilhelm |
| 5,088,586 | A | 2/1992 | Isobe et al. |
| 5,091,713 | A | 2/1992 | Horne et al. |
| 5,095,195 | A | 3/1992 | Harman et al. |
| 5,105,069 | A | 4/1992 | Hakenewerth et al. |
| 5,128,862 | A | 7/1992 | Mueller |
| 5,133,441 | A | 7/1992 | Brown |
| 5,139,384 | A | 8/1992 | Tuttobene |
| 5,143,193 | A | 9/1992 | Geraci |
| 5,159,560 | A | 10/1992 | Newell et al. |
| 5,205,436 | A | 4/1993 | Savage |
| 5,206,814 | A | 4/1993 | Cahlander et al. |
| 5,207,784 | A | 5/1993 | Schwartzendruber |
| 5,212,649 | A | 5/1993 | Pelletier |
| 5,235,509 | A | 8/1993 | Mueller et al. |
| RE34,369 | E | 9/1993 | Darden et al. |
| 5,273,183 | A | 12/1993 | Tuttobene |
| 5,313,392 | A | 5/1994 | Temma et al. |
| 5,313,393 | A | 5/1994 | Varley et al. |
| 5,319,705 | A | 6/1994 | Halter et al. |
| 5,323,327 | A | 6/1994 | Carmichael et al. |
| 5,353,219 | A | 10/1994 | Mueller et al. |
| 5,383,111 | A | 1/1995 | Homma et al. |
| 5,385,265 | A | 1/1995 | Schlamp |
| 5,408,417 | A | 4/1995 | Wilder |
| 5,409,092 | A | 4/1995 | Itako et al. |
| 5,418,713 | A | 5/1995 | Allen |
| 5,442,568 | A | 8/1995 | Ostendorf et al. |
| 5,445,295 | A | 8/1995 | Brown |
| 5,450,584 | A | 9/1995 | Sekiguchi et al. |
| 5,450,938 | A | 9/1995 | Rademacher |
| 5,467,892 | A | 11/1995 | Schlamp |
| 5,482,139 | A | 1/1996 | Rivalto |
| 5,484,988 | A | 1/1996 | Hills et al. |
| 5,499,707 | A | 3/1996 | Steury |
| 5,504,675 | A | 4/1996 | Cragun et al. |
| 5,510,979 | A | 4/1996 | Moderi et al. |
| 5,513,116 | A | 4/1996 | Buckley et al. |
| 5,546,316 | A | 8/1996 | Buckley |
| 5,550,746 | A | 8/1996 | Jacobs |
| 5,555,143 | A | 9/1996 | Hinnen et al. |
| 5,559,714 | A | 9/1996 | Banks |
| 5,561,604 | A | 10/1996 | Buckley |
| 5,576,951 | A | 11/1996 | Lockwood |
| 5,594,791 | A | 1/1997 | Szlam et al. |
| 5,615,123 | A | 3/1997 | Davidson et al. |
| 5,632,681 | A | 5/1997 | Bakoglu et al. |
| 5,633,839 | A | 5/1997 | Alexander et al. |
| 5,637,845 | A | 6/1997 | Kolls |
| 5,644,727 | A | 7/1997 | Atkins |
| 5,647,505 | A | 7/1997 | Scott |
| 5,647,507 | A | 7/1997 | Kasper |
| 5,682,276 | A | 10/1997 | Hinnen et al. |
| 5,694,546 | A | 12/1997 | Reisman |
| 5,699,262 | A | 12/1997 | Lang et al. |
| 5,699,528 | A | 12/1997 | Hogan |
| 5,715,403 | A | 2/1998 | Stefik |
| 5,724,069 | A | 3/1998 | Chen |
| 5,724,521 | A | 3/1998 | Dedrick |
| 5,732,398 | A | 3/1998 | Tagawa |
| 5,734,150 | A | 3/1998 | Brown et al. |
| 5,748,485 | A | 5/1998 | Christiansen et al. |
| 5,754,850 | A | 5/1998 | Janssen |
| 5,761,071 | A | 6/1998 | Bernstein et al. |
| 5,765,142 | A | 6/1998 | Allred et al. |
| 5,768,142 | A | 6/1998 | Jacobs |
| 5,769,269 | A | 6/1998 | Peters |
| 5,777,884 | A | 7/1998 | Belka et al. |
| H1743 | H | 8/1998 | Graves et al. |
| 5,790,677 | A | 8/1998 | Fox et al. |
| 5,806,071 | A | 9/1998 | Balderrama et al. |
| 5,822,216 | A | 10/1998 | Satchell et al. |
| 5,822,291 | A | 10/1998 | Brindze et al. |
| 5,831,862 | A | 11/1998 | Hetrick et al. |
| 5,832,503 | A | 11/1998 | Malik et al. |
| 5,850,442 | A | 12/1998 | Muftic |
| 5,870,716 | A | 2/1999 | Sugiyama et al. |
| 5,873,069 | A | 2/1999 | Reuhl et al. |
| 5,875,110 | A | 2/1999 | Jacobs |
| 5,884,278 | A | 3/1999 | Powell |
| 5,898,594 | A | 4/1999 | Leason et al. |
| 5,900,608 | A | 5/1999 | Iida |
| 5,905,246 | A | 5/1999 | Fajkowski |

5,923,016 A 7/1999 Fredregill et al.
5,930,771 A 7/1999 Stapp
5,934,439 A 8/1999 Kanoh et al.
5,936,452 A 8/1999 Utsuno et al.
5,938,510 A 8/1999 Takahashi et al.
5,941,363 A 8/1999 Partyka et al.
5,943,423 A 8/1999 Muftic
5,950,173 A 9/1999 Perkowski
5,954,797 A 9/1999 Sidey
5,956,694 A 9/1999 Powell
5,959,869 A 9/1999 Miller et al.
5,963,134 A 10/1999 Bowers et al.
5,963,452 A 10/1999 Etoh et al.
5,984,509 A 11/1999 Scott
5,988,346 A 11/1999 Tedesco et al.
5,988,431 A 11/1999 Roe
5,997,170 A 12/1999 Brodbeck
6,002,395 A 12/1999 Wagner
6,014,137 A 1/2000 Burns
6,029,851 A 2/2000 Jenkins et al.
6,039,244 A 3/2000 Finsterwald
6,044,362 A 3/2000 Neely
6,047,338 A 4/2000 Grolemund
6,050,448 A 4/2000 Willis
6,056,194 A 5/2000 Kolls
6,058,373 A 5/2000 Blinn et al.
6,061,660 A 5/2000 Eggleston et al.
6,062,478 A 5/2000 Izaguirre et al.
6,072,481 A 6/2000 Matsushita et al.
6,076,101 A 6/2000 Kamakura et al.
6,078,848 A 6/2000 Bernstein et al.
6,085,888 A 7/2000 Tedesco et al.
6,101,483 A 8/2000 Petrovich et al.
6,109,524 A 8/2000 Kanoh et al.
6,115,649 A 9/2000 Sakata
6,119,934 A 9/2000 Kolls
6,123,223 A 9/2000 Watkins
6,125,353 A 9/2000 Yagasaki
6,126,036 A 10/2000 d'Alayer de Costemore d'Arc et al.
6,134,547 A 10/2000 Huxley et al.
6,138,911 A 10/2000 Fredregill et al.
6,161,059 A 12/2000 Tedesco et al.
6,164,528 A 12/2000 Hills
6,169,483 B1 1/2001 Ghaffari et al.
6,179,206 B1 1/2001 Matsumori
6,181,981 B1 1/2001 Varga et al.
6,182,857 B1 2/2001 Hamm et al.
6,195,661 B1 2/2001 Filepp et al.
6,199,141 B1 3/2001 Weinreb
6,199,720 B1 3/2001 Rudick et al.
6,201,474 B1 3/2001 Brady et al.
6,202,006 B1 3/2001 Scott
6,209,322 B1 4/2001 Yoshida et al.
6,243,687 B1 6/2001 Powell
6,250,452 B1 6/2001 Partyka et al.
6,264,104 B1 7/2001 Jenkins et al.
6,269,285 B1 7/2001 Mignault
6,286,139 B1 9/2001 Decinque
6,289,322 B1 9/2001 Kitchen et al.
6,295,482 B1 9/2001 Tognazzini
6,298,972 B1 10/2001 Tedesco et al.
6,311,165 B1 10/2001 Coutts
6,317,649 B1 11/2001 Tedesco et al.
6,321,985 B1 11/2001 Kolls
6,324,520 B1 11/2001 Walker et al.
6,327,230 B1 12/2001 Miller et al.
6,330,958 B1 12/2001 Ruskin et al.
6,334,110 B1 12/2001 Walter et al.
6,336,098 B1 1/2002 Fortenberry et al.
6,354,501 B1 * 3/2002 Outwater et al. ..... 235/462.01
6,360,139 B1 3/2002 Jacobs
6,366,914 B1 4/2002 Stern
6,367,653 B1 4/2002 Ruskin et al.
6,367,696 B1 4/2002 Inamitsu et al.
6,397,126 B1 5/2002 Nelson
6,397,199 B1 5/2002 Goodwin, III
6,412,654 B1 7/2002 Cleeve
6,415,555 B1 7/2002 Montague
6,415,950 B1 7/2002 Robrechts
6,416,270 B1 7/2002 Steury
6,424,706 B1 7/2002 Katz
6,430,470 B1 8/2002 Nakajima et al.
6,435,406 B1 8/2002 Pentel
6,456,981 B1 9/2002 Dejaeger
6,457,038 B1 9/2002 Defosse
6,462,644 B1 10/2002 Howell
6,466,658 B2 10/2002 Schelberg, Jr. et al.
6,466,830 B1 10/2002 Manross
6,477,503 B1 11/2002 Mankes
6,493,110 B1 12/2002 Roberts
6,522,772 B1 2/2003 Morrison
6,527,176 B2 3/2003 Baric
6,539,282 B2 3/2003 Metcalf et al.
6,540,100 B2 4/2003 Credle, Jr. et al.
6,575,363 B1 6/2003 Leason
6,584,309 B1 6/2003 Whigham
6,584,450 B1 6/2003 Hastings et al.
6,584,564 B2 6/2003 Olkin et al.
6,587,748 B2 7/2003 Baack
6,587,835 B1 7/2003 Treyz et al.
6,595,342 B1 7/2003 Maritzen et al.
6,606,602 B1 8/2003 Kolls
6,628,764 B1 9/2003 Petite
6,640,159 B2 10/2003 Holmes et al.
6,644,455 B2 * 11/2003 Ichikawa ..... 194/205
6,644,495 B2 11/2003 Ruskin et al.
6,655,580 B1 12/2003 Ergo et al.
6,658,323 B2 12/2003 Tedesco et al.
6,688,523 B1 2/2004 Koenck
6,696,918 B2 2/2004 Kucharczyk et al.
6,707,380 B2 3/2004 Maloney
6,707,381 B1 3/2004 Maloney
6,708,879 B2 3/2004 Hunt
6,711,464 B1 3/2004 Yap
6,711,465 B2 3/2004 Tomassi
6,728,532 B1 4/2004 Ahonen
6,742,673 B2 6/2004 Credle, Jr. et al.
6,748,296 B2 6/2004 Banerjee et al.
6,748,539 B1 6/2004 Lotspiech
6,754,559 B2 6/2004 Itako
6,757,585 B2 6/2004 Ohtsuki
6,792,334 B2 9/2004 Metcalf
6,794,634 B2 9/2004 Hair, III et al.
6,814,256 B2 11/2004 Clark
6,847,861 B2 1/2005 Lunak et al.
6,850,816 B2 2/2005 Garratt
6,851,092 B2 2/2005 Chang et al.
6,854,642 B2 2/2005 Metcalf et al.
6,923,371 B2 8/2005 Goodfellow
6,932,270 B1 8/2005 Fajkowski
6,954,732 B1 10/2005 DeLapa et al.
6,959,285 B2 10/2005 Stefanik et al.
6,959,286 B2 10/2005 Perkowski
6,965,869 B1 11/2005 Tomita et al.
6,968,365 B2 11/2005 Hollstrom et al.
6,980,887 B2 12/2005 Varga et al.
6,985,607 B2 * 1/2006 Alasia et al. ..... 382/112
7,024,381 B1 4/2006 Hastings et al.
7,024,390 B1 4/2006 Mori et al.
7,043,497 B1 5/2006 Carty et al.
7,053,773 B2 5/2006 McGarry et al.
7,058,581 B1 6/2006 Young
7,076,329 B1 7/2006 Kolls
7,079,230 B1 * 7/2006 McInerney et al. ..... 356/71
7,079,822 B2 7/2006 Gunji et al.
7,079,922 B2 7/2006 Komai
7,085,556 B2 8/2006 Offer
7,085,727 B2 8/2006 VanOrman
7,108,180 B2 9/2006 Brusso et al.
7,139,731 B1 11/2006 Alvin
7,167,842 B1 1/2007 Josephson, II et al.
7,167,892 B2 1/2007 Defosse et al.
7,174,317 B2 2/2007 Phillips et al.
7,191,952 B2 3/2007 Blossom
7,203,675 B1 4/2007 Papierniak et al.
7,209,893 B2 4/2007 Nii
7,233,916 B2 6/2007 Schultz 7,234,609 B2 6/2007 DeLazzer et al.
7,236,946 B2 6/2007 Bates et al.
7,240,843 B2 7/2007 Paul et al.
7,315,629 B2 * 1/2008 Alasia et al. ..... 382/112
7,347,359 B2 3/2008 Boyes
7,350,230 B2 3/2008 Forrest
7,366,586 B2 4/2008 Kaplan et al.
7,389,243 B2 6/2008 Gross
7,406,693 B1 7/2008 Goodwin, III
7,412,073 B2 * 8/2008 Alasia et al. ..... 382/100
7,444,296 B1 10/2008 Barber et al.
7,447,605 B2 11/2008 Kuehnrich
7,499,768 B2 3/2009 Hoersten et al.
7,584,869 B2 9/2009 DeLazzer et al.
7,747,346 B2 * 6/2010 Lowe et al. ..... 700/242
7,774,233 B2 8/2010 Barber et al.
7,787,987 B2 8/2010 Kuehnrich et al.
7,797,077 B2 9/2010 Hale
7,853,354 B2 12/2010 Kuehnrich et al.
7,860,606 B2 12/2010 Rudy
7,988,049 B2 * 8/2011 Kuehnrich ..... 235/462.01
8,060,249 B2 * 11/2011 Bear et al. ..... 700/244
2001/0011252 A1 8/2001 Kasahara
2001/0011680 A1 8/2001 Soltesz et al.
2001/0027357 A1 10/2001 Grobler
2001/0035425 A1 11/2001 Rocco
2001/0037207 A1 11/2001 Dejaeger
2001/0047223 A1 11/2001 Metcalf
2002/0029196 A1 3/2002 Metcalf et al.
2002/0046122 A1 4/2002 Barber et al.
2002/0046123 A1 4/2002 Nicolini
2002/0065579 A1 5/2002 Tedesco et al.
2002/0074397 A1 6/2002 Matthews
2002/0082917 A1 6/2002 Takano
2002/0084322 A1 7/2002 Baric
2002/0087334 A1 7/2002 Yamaguchi et al.
2002/0095680 A1 7/2002 Davidson
2002/0125314 A1 9/2002 Jenkins et al.
2002/0133269 A1 9/2002 Anselmi
2002/0161475 A1 10/2002 Varga et al.
2002/0165787 A1 11/2002 Bates et al.
2002/0165788 A1 11/2002 Bates et al.
2002/0165821 A1 11/2002 Tree
2002/0169715 A1 11/2002 Ruth et al.
2002/0183882 A1 12/2002 Dearing et al.
2002/0195491 A1 12/2002 Bunch
2003/0004828 A1 1/2003 Epstein
2003/0023453 A1 1/2003 Hafen et al.
2003/0033054 A1 2/2003 Yamazaki
2003/0057219 A1 3/2003 Risolia
2003/0061094 A1 3/2003 Banerjee et al.
2003/0105554 A1 6/2003 Eggenberger et al.
2003/0125961 A1 7/2003 Janda
2003/0130762 A1 7/2003 Tomassi
2003/0149510 A1 8/2003 Takahashi
2003/0163382 A1 8/2003 Stefanik et al.
2003/0167231 A1 9/2003 Winking et al.
2003/0212471 A1 11/2003 Chakravarti
2004/0006537 A1 1/2004 Zelechoski et al.
2004/0010340 A1 1/2004 Guindulain Vidondo
2004/0016620 A1 1/2004 Davis
2004/0030446 A1 2/2004 Guindulain Vidondo
2004/0050648 A1 3/2004 Carapelli
2004/0064377 A1 4/2004 Ergo et al.
2004/0065579 A1 4/2004 Wood
2004/0068346 A1 4/2004 Boucher
2004/0068451 A1 4/2004 Lenk et al.
2004/0078328 A1 4/2004 Talbert et al.
2004/0079798 A1 4/2004 Messenger
2004/0133466 A1 7/2004 Redmond et al.
2004/0153413 A1 8/2004 Gross
2004/0158503 A1 8/2004 Gross
2004/0158504 A1 8/2004 Gross
2004/0158871 A1 8/2004 Jacobson
2004/0162783 A1 8/2004 Gross
2004/0172274 A1 9/2004 Gross
2004/0172275 A1 9/2004 Gross
2004/0172342 A1 9/2004 Gross
2004/0243479 A1 12/2004 Gross
2004/0243480 A1 12/2004 Gross
2004/0249711 A1 12/2004 Walker et al.
2004/0254676 A1 12/2004 Blust et al.
2004/0256402 A1 12/2004 Chirnomas
2004/0260600 A1 12/2004 Gross
2004/0267604 A1 12/2004 Gross
2004/0267640 A1 12/2004 Bong et al.
2005/0027648 A1 2/2005 Knowles et al.
2005/0033855 A1 2/2005 Moradi
2005/0060062 A1 3/2005 Walker et al.
2005/0060246 A1 3/2005 Lastinger et al.
2005/0080510 A1 4/2005 Bates et al.
2005/0085946 A1 4/2005 Visikivi et al.
2005/0086127 A1 4/2005 Hastings et al.
2005/0091069 A1 4/2005 Chuang
2005/0096936 A1 5/2005 Lambers
2005/0109836 A1 5/2005 Ben-Aissa
2005/0177494 A1 8/2005 Kelly
2005/0197855 A1 9/2005 Nudd
2005/0216120 A1 * 9/2005 Rosenberg et al. ..... 700/244
2005/0230410 A1 10/2005 DeLazzer
2005/0230473 A1 10/2005 Fajkowski
2005/0261977 A1 11/2005 Kiji et al.
2005/0267819 A1 12/2005 Kaplan
2005/0274793 A1 12/2005 Cantini et al.
2005/0283434 A1 12/2005 Hahn-Carlson et al.
2005/0289032 A1 12/2005 Hoblit
2006/0026031 A1 2/2006 Gentling
2006/0041508 A1 2/2006 Pham et al.
2006/0074777 A1 4/2006 Anderson
2006/0095286 A1 5/2006 Kimura
2006/0095339 A1 5/2006 Hayashi et al.
2006/0096997 A1 5/2006 Yeo
2006/0122881 A1 6/2006 Walker et al.
2006/0149685 A1 7/2006 Gross
2006/0155575 A1 7/2006 Gross
2006/0184395 A1 8/2006 Millwee
2006/0190345 A1 8/2006 Crowley
2006/0212360 A1 9/2006 Stefanik et al.
2006/0212367 A1 9/2006 Gross
2006/0231612 A1 10/2006 Walker et al.
2006/0231613 A1 10/2006 Walker et al.
2006/0231614 A1 10/2006 Walker et al.
2006/0235746 A1 10/2006 Hammond
2006/0235747 A1 10/2006 Hammond
2006/0241967 A1 10/2006 Gross
2006/0242059 A1 10/2006 Hansen
2006/0247823 A1 11/2006 Boucher
2006/0254862 A1 11/2006 Hoersten
2006/0259190 A1 11/2006 Hale
2006/0259191 A1 11/2006 Lowe
2006/0259192 A1 11/2006 Lowe et al.
2006/0265101 A1 11/2006 Kaplan
2006/0265286 A1 11/2006 Evangelist et al.
2006/0266823 A1 11/2006 Passen et al.
2006/0272922 A1 12/2006 Hoersten
2006/0273152 A1 12/2006 Fields
2007/0005438 A1 1/2007 Evangelist et al.
2007/0011093 A1 1/2007 Tree
2007/0050083 A1 3/2007 Signorelli et al.
2007/0050256 A1 3/2007 Walker et al.
2007/0050266 A1 3/2007 Barber et al.
2007/0051802 A1 3/2007 Barber et al.
2007/0063020 A1 3/2007 Barrafato
2007/0063027 A1 3/2007 Belfer et al.
2007/0084872 A1 4/2007 Hair
2007/0084917 A1 4/2007 Fajkowski
2007/0094245 A1 4/2007 Vigil
2007/0095901 A1 5/2007 Illingworth
2007/0125104 A1 6/2007 Ehlers
2007/0130020 A1 6/2007 Paolini
2007/0136247 A1 6/2007 Vigil
2007/0156442 A1 7/2007 Ali
2007/0156578 A1 7/2007 Perazolo
2007/0162183 A1 7/2007 Pinney et al.
2007/0162184 A1 7/2007 Pinney et al.
2007/0169132 A1 7/2007 Blust et al.
2007/0175986 A1 8/2007 Petrone
2007/0179668 A1 8/2007 Mellin

| | | | | |
|---|---|---|---|---|
| 2007/0185776 | A1 | 8/2007 | Nguyen et al. | |
| 2007/0210153 | A1 | 9/2007 | Walker | |
| 2007/0213871 | A1 | 9/2007 | Whitten et al. | |
| 2007/0276537 | A1 | 11/2007 | Walker et al. | |
| 2008/0027835 | A1 | 1/2008 | LeMasters et al. | |
| 2008/0040211 | A1 | 2/2008 | Walker et al. | |
| 2008/0125906 | A1 | 5/2008 | Bates et al. | |
| 2008/0239961 | A1 | 10/2008 | Hilerio et al. | |
| 2008/0275591 | A1 | 11/2008 | Chirnomas | |
| 2009/0018792 | A1 | 1/2009 | Kuehnrich | |
| 2009/0048932 | A1* | 2/2009 | Barber | 705/14 |
| 2009/0089187 | A1* | 4/2009 | Hoersten et al. | 705/28 |
| 2010/0057871 | A1 | 3/2010 | Kaplan et al. | |
| 2010/0312380 | A1 | 12/2010 | Lowe et al. | |
| 2010/0318219 | A1 | 12/2010 | Kuehnrich et al. | |
| 2011/0004536 | A1 | 1/2011 | Hoersten et al. | |
| 2011/0047010 | A1 | 2/2011 | Arnold et al. | |
| 2011/0060454 | A1 | 3/2011 | Lowe et al. | |
| 2011/0060456 | A1 | 3/2011 | Lowe et al. | |
| 2011/0130873 | A1 | 6/2011 | Yepez et al. | |
| 2011/0153067 | A1 | 6/2011 | Weinshenker | |
| 2011/0153071 | A1 | 6/2011 | Claessen | |

FOREIGN PATENT DOCUMENTS

| | | |
|---|---|---|
| DE | 35 29 155 | 2/1987 |
| EP | 0060643 | 9/1982 |
| EP | 205691 | 12/1986 |
| EP | 0249367 | 12/1987 |
| EP | 572119 | 12/1993 |
| EP | 287367 | 10/1998 |
| EP | 986033 | 3/2000 |
| EP | 1367549 | 12/2003 |
| EP | 1396824 | 7/2010 |
| FR | 2549624 | 1/1985 |
| FR | 2559599 | 8/1985 |
| FR | 2562293 | 10/1995 |
| GB | 380926 | 9/1932 |
| GB | 2143662 | 2/1985 |
| GB | 2172720 | 9/1986 |
| GB | 2402242 | 12/2004 |
| JP | 55156107 | 12/1980 |
| JP | 56047855 | 4/1981 |
| JP | 02178795 | 7/1990 |
| JP | 03062189 | 3/1991 |
| JP | 03119496 | 5/1991 |
| JP | 10247982 | 9/1998 |
| JP | 00149136 | 3/2000 |
| JP | 03036328 | 2/2003 |
| JP | 04094857 | 3/2004 |
| JP | 09043143 | 2/2009 |
| KR | 1020030089154 | 11/2003 |
| KR | 1020040069053 | 8/2004 |
| KR | 1020060080175 | 7/2006 |
| KR | 1020070021301 | 2/2007 |
| WO | WO 87/00948 | 2/1987 |
| WO | WO 87/05425 | 9/1987 |
| WO | WO 88/04085 | 6/1988 |
| WO | WO 93/00644 | 1/1993 |
| WO | 96/18972 | 6/1996 |
| WO | WO 88/06771 | 9/1998 |
| WO | WO 99/24902 | 5/1999 |
| WO | WO 00/38120 | 6/2000 |
| WO | WO 00/72160 | 11/2000 |
| WO | WO 02/29708 | 4/2002 |
| WO | WO 2004/070646 | 8/2004 |
| WO | WO 2005/062887 | 7/2005 |
| WO | WO 2006/112817 | 10/2006 |
| WO | WO 2006/116108 | 11/2006 |
| WO | WO 2006/116109 | 11/2006 |
| WO | WO 2006/116110 | 11/2006 |
| WO | WO 2006/116112 | 11/2006 |
| WO | WO 2006/116113 | 11/2006 |
| WO | WO 2006/116114 | 11/2006 |
| WO | WO 2006/116115 | 11/2006 |
| WO | WO 2006/116116 | 11/2006 |
| WO | 2007/012816 | 1/2007 |
| WO | WO 2011/022689 | 2/2011 |
| WO | WO 2011/028727 | 3/2011 |
| WO | WO 2011/028728 | 3/2011 |
| WO | WO 2011/031532 | 3/2011 |

OTHER PUBLICATIONS

Office Action mailed Aug. 28, 2006 for U.S. Appl. No. 10/824781.
Response to Office Action mailed Aug. 28, 2006 for U.S. Appl. No. 10/824781, filed Jan. 29, 2007.
Patent Cooperation Treaty International Search Report for Application PCT/US2006/015129 mailed Sep. 20, 2006.
Patent Cooperation Treaty International Search Report for Application PCT/US2006/015130 mailed Nov. 22, 2006.
Patent Cooperation Treaty International Search Report for Application PCT/US2006/15125 mailed Jan. 11, 2007.
Notice of Allowance mailed Apr. 18, 2007 for U.S. Appl. No. 10/824781.
Office Action mailed Apr. 24, 2007 for U.S. Appl. No. 11/409,516.
Response to Office Action mailed Apr. 24, 2007 for U.S. Appl. No. 11/409,516, filed Sep. 24, 2007.
Office Action mailed Apr. 27, 2007 for U.S. Appl. No. 11/408,630.
Response to Office Action mailed Apr. 27, 2007 for U.S. Appl. No. 11/408,630, filed Sep. 27, 2007.
Office Action mailed Sep. 27, 2007 for U.S. Appl. No. 11/408,610.
Response to Office Action mailed Sep. 27, 2007 for U.S. Appl. No. 11/408,610, filed Feb. 26, 2008.
Patent Cooperation Treaty International Search Report for Application PCT/US2006/015132 mailed May 10, 2007.
Patent Cooperation Treaty International Search Report for Application PCT/US2006/015133 mailed Jun. 6, 2007.
Office Action mailed Jun. 29, 2007 for U.S. Appl. No. 11/408,607.
Response to Office Action mailed Jun. 29, 2007 for U.S. Appl. No. 11/408,607, filed Oct. 26, 2007.
Office Action mailed Sep. 6, 2007 for U.S. Appl. No. 11/408,789.
Response to Office Action mailed Sep. 6, 2007 for U.S. Appl. 11/408,789, filed Dec. 6, 2007.
Office Action mailed Sep. 10, 2007 for U.S. Appl. No. 11/409,175.
Response to Office Action mailed Sep. 10, 2007 for U.S. Appl. No. 11/409,175, filed Feb. 11, 2008.
Office Action mailed Sep. 27, 2007 for U.S. Appl. No. 11/409,260.
Office Action mailed Dec. 6, 2007 for U.S. Appl. No. 11/408,630.
Response to Office Action mailed Dec. 6, 2007 for U.S. Appl. No. 11/408,630, filed Mar. 6, 2008.
Notice of Allowance mailed Dec. 7, 2007 for U.S. Appl. No. 11/409,516.
Office Action mailed Dec. 21, 2007 for U.S. Appl. No. 11/408,632.
Response to Office Action mailed Dec. 21, 2007 for U.S. Appl. No. 11/408,632, filed Apr. 21, 2008.
Office Action mailed Jan. 24, 2008 for U.S. Appl. No. 11/408,607.
Response to Office Action mailed Jan. 24, 2008 for U.S. Appl. No. 11/408,607, filed Apr. 24, 2008.
Office Action mailed Mar. 17, 2008 for U.S. Appl. No. 11/408,789.
Response to Office Action mailed Mar. 17, 2008 for U.S. Appl. No. 11/408,789, filed May 19, 2008.
Patent Cooperation Treaty International Search Report for Application PCT/US2006/15126 mailed Apr. 3, 2008.
Office Action mailed Apr. 23, 2008 for U.S. Appl. No. 11/408,630.
Response to Office Action mailed Apr. 23, 2008 for U.S. Appl. No. 11/408,630, filed Jul. 23, 2008.
Office Action mailed May 13, 2008 for U.S. Appl. No. 11/409,175.
Response to Office Action mailed May 13, 2008 for U.S. Appl. No. 11/409,175, filed Oct. 14, 2008.
Office Action mailed May 22, 2008 for U.S. Appl. No. 11/408,610.
Response to Office Action mailed May 22, 2008 for U.S. Appl. No. 11/408,610, filed Aug. 22, 2008.
Patent Cooperation Treaty International Search Report and Written Option for PCT/US2006/15127 mailed Jun. 19, 2008.
Notice of Allowance mailed Jun. 26, 2008 for U.S. Appl. No. 11/408,607.
Patent Cooperation Treaty International Search Report and Written Opinion for PCT/US2006/15131 mailed Jul. 7, 2008.
Office Action mailed Jul. 28, 2008 for U.S. Appl. No. 11/408,789.
Appeal Brief filed for U.S. Appl. No. 11/408,789, filed Mar. 11, 2009.

Office Action mailed Oct. 17, 2008 for U.S. Appl. No. 11/408,610.
Response to Office Action mailed Oct. 17, 2008 for U.S. Appl. No. 11/408,610, filed Jan. 21, 2009.
Notice of Allowance Dated Oct. 29, 2008 for U.S. Appl. No. 11/408,630.
Final Office Action mailed Oct. 29, 2008 for U.S. Appl. No. 11/408,632.
Response to Final Office Action mailed Oct. 29, 2008 for U.S. Appl. No. 11/408,632, filed Jan. 28, 2009.
Office Action mailed Nov. 18, 2008 for U.S. Appl. No. 11/767,065.
Response to Office Action mailed Nov. 18, 2008 for U.S. Appl. No. 11/767,065, filed Feb. 18, 2009.
Office Action mailed Dec. 30, 2008 for U.S. Appl. No. 11/863,909.
Response to Office Action mailed Dec. 30, 2008 for U.S. Appl. No. 11/863,909, filed Apr. 20, 2009.
Office Action mailed Jan. 6, 2009 for U.S. Appl. No. 11/409,175.
Response to Office Action mailed Jan. 6, 2009 for U.S. Appl. No. 11/409,175, filed Apr. 6, 2009.
Supplementary Search Report mailed Jan. 21, 2009 for European Patent Application EP05736275.
Office Action mailed Mar. 17, 2009 for U.S. Appl. No. 11/408,632.
Response to Office Action mailed Mar. 17, 2009 for U.S. Appl. No. 11/408,632, filed Jul. 16, 2009.
Office Action mailed Mar. 31, 2009 for U.S. Appl. No. 12/056,215.
Response to Office Action mailed Mar. 31, 2009 for U.S. Appl. No. 12/056,215, filed Jun. 30, 2009.
Final Office Action mailed Apr. 16, 2009 for U.S. Appl. No. 11/408,610.
Appeal Brief Filed for U.S. Appl. No. 11/408,610, filed Oct. 13, 2009.
Notice of Allowance mailed May 4, 2009 for U.S. Appl. No. 11/767,065.
Examination Report for EP 05736275.8 mailed May 15, 2009.
Office Action mailed Jun. 18, 2009 for U.S. Appl. No. 11/409,175.
Response to Office Action mailed Jun. 18, 2009 for U.S. Appl. No. 11/409,175, filed Sep. 18, 2009.
Office Action mailed Jun. 26, 2009 for U.S. Appl. No. 11/408,789.
Response to Office Action mailed Jun. 26, 2009 for U.S. Appl. No. 11/408,789, filed Sep. 11, 2009.
Response to Office Action mailed Jul. 27, 2009 for U.S. Appl. No. 11/863,909, filed Oct. 26, 2009.
Office Action mailed Aug. 3, 2009 for U.S. Appl. No. 12/110,101.
Response to Office Action mailed Aug. 3, 2009 for U.S. Appl. No. 12/110,101, filed Nov. 3, 2009.
Final Office Action mailed Oct. 20, 2009 for U.S. Appl. No. 12/056,215.
Response to Final Office Action mailed Oct. 20, 2009 for U.S. Appl. No. 12/056,215, filed Dec. 18, 2009.
Office Action mailed Nov. 13, 2009 for U.S. Appl. No. 11/408,632.
Response to Office Action mailed Nov. 13, 2009 for U.S. Appl. No. 11/408,632, filed Feb. 15, 2010.
Notice of Allowance mailed Dec. 2, 2009 for U.S. Appl. No. 12/110,101.
Final Office Action mailed Dec. 9, 2009 for U.S. Appl. No. 11/409,175.
Appeal Brief filed on May 10, 2010 for U.S. Appl. No. 11/409,175.
Notice of Allowance mailed Dec. 31, 2009 for U.S. Appl. No. 11/408,789.
Office Action mailed Jan. 11, 2010 for U.S. Appl. No. 11/863,909.
Office Action mailed Jan. 25, 2010 for U.S. Appl. No. 12/056,215.
Response to Office Action mailed Jan. 25, 2010 for U.S. Appl. No. 12/056,215, filed Apr. 23, 2010.
Notice of Allowance mailed Feb. 23, 2011 for U.S. Appl. No. 12/235,715.
Examiner's Answer to Appeal Brief dated Sep. 2, 2010 for U.S. Appl. No. 11/409,175.
Reply Brief filed on Oct. 29, 2010 for U.S. Appl. No. 11/409,175.
Patent Cooperation Treaty International Search Report and Written Opinion for PCT/US2010/046219 mailed Feb. 28, 2011.
Patent Cooperation Treaty International Search Report and Written Opinion for PCT/US2010/046872 mailed Mar. 29, 2011.
Patent Cooperation Treaty International Search Report and Written Opinion for PCT/US2010/047371 mailed Apr. 29, 2011.
Patent Cooperation Treaty International Search Report and Written Opinion for PCT/US2010/047374 mailed May 2, 2011.
1982 Issue Rolling Stones Magazine, Film Rentals by Vending Machine.
1984 Picture of U.S. Installation of Japanese Manufactured VHS Rental Kiosk.
Examiner's Answer to Appeal Brief for U.S. Appl. No. 11/408,610 mailed May 25, 2010.
Reply Brief for U.S. Appl. No. 11/408,610, filed Jul. 26, 2010.
Notice of Allowance for U.S. Appl. No. 11/408,632, mailed Apr. 6, 2010.
Notice of Allowance for U.S. Appl. No. 12/056,215, mailed Jul. 26, 2010.
Office Action for U.S. Appl. No. 12/782,506 mailed Mar. 7, 2012.
Office Action for U.S. Appl. No. 12/966,831 mailed Nov. 2, 2011.
Response to Office Action for U.S. Appl. No. 12/966,831 mailed Nov. 2, 2011 (filed Feb. 2, 2012).
Office Action for U.S. Appl. No. 12/825,069 mailed Dec. 17, 2010.
Response to Office Action for U.S. Appl. No. 12/825,069 mailed Dec. 17, 2010 (filed May 17, 2011).
Office Action for U.S. Appl. No. 12/825,069 mailed Aug. 5, 2011.
Response to Office Action for U.S. Appl. No. 12/825,069 mailed Aug. 5, 2011 (filed Oct. 5, 2011).
Notice of Allowance for U.S. Appl. No. 12/825,069 mailed Nov. 28, 2011.
Office Action for U.S. Appl. No. 11/863,909 mailed Dec. 30, 2008.
Response to Office Action for U.S. Appl. No. 11/863,909 (filed Oct. 26, 2009).
Office Action mailed Jul. 27, 2009 for U.S. Appl. No. 11/863,909.
Response to Office Action for U.S. Appl. No. 11/863,909, filed Oct. 26, 2009.
Office Action for U.S. Appl. No. 12/825,069 mailed Jan. 11, 2010.
Office Action for U.S. Appl. No. 12/545,552 mailed Dec. 22, 2011.
Response to Office Action for U.S. Appl. No. 12/545,552, filed Mar. 22, 2012.
Search Report and Written Opinion for PCT Application No. PCT/US10/46219 dated Feb. 28, 2011.
International Preliminary Report on Patentability for PCT Application No. PCT/US10/46219 dated Feb. 21, 2012.
Office Action for U.S. Appl. No. 12/554,905 mailed Sep. 29, 2011.
Response to Office Action for U.S. Appl. No. 12/554,905, filed Dec. 29, 2011.
Office Action for U.S. Appl. No. 12/554,905 mailed May 4, 2012.
Search Report and Written Opinion for PCT Application No. PCT/US10/47374 mailed May 2, 2011.
International Preliminary Report on Patentability for PCT Application No. PCT/US10/47374 mailed Mar. 6, 2012.
Office Action for U.S. Appl. No. 12/554,906 mailed Sep. 30, 2011.
Response to Office Action for U.S. Appl. No. 12/554,906 mailed Sep. 30, 2011 (filed Dec. 30, 2011).
Office Action for U.S. Appl. No. 12/554,906 mailed May 7, 2012.
Search Report and Written Opinion for PCT Application No. PCT/US10/47371 mailed Apr. 29, 2011.
International Search Report and Written Opinion for PCT Application No. PCT/US2010/047371 mailed Feb. 29, 2012.
Office Action for U.S. Appl. No. 12/861,689 mailed Sep. 22, 2011.
Response to Office Action for U.S. Appl. No. 12/861,689, filed Mar. 22, 2012.
International Search Report and Written Opinion for PCT Application No. PCT/US11/48686 mailed Apr. 9, 2012.

* cited by examiner

ARTICLE VENDING MACHINE AND METHOD FOR AUTHENTICATING RECEIVED ARTICLES

CROSS REFERENCE TO RELATED APPLICATION

The subject matter of the present application relates to and can work in conjunction with the subject matter of U.S. patent application Ser. No. 12/861,689, filed on Aug. 23, 2010, entitled "ARTICLE RETURN SYSTEM AND METHOD OF USING SAME" which is incorporated herein by reference in its entirety.

TECHNICAL FIELD

The present invention relates to improvements in article dispensing machines and components and methods related to the same. More particularly, the present invention relates to a digital video disc (DVD) dispensing apparatus and method for authenticating returned DVDs having a security feature.

BACKGROUND AND SUMMARY OF THE INVENTION

While the present invention is often described herein with reference to a digital video disc distribution system, an application to which the present invention is advantageously suited, it will be readily apparent that the present invention is not limited to that application and can be employed in article dispensing systems used to distribute a wide variety of rentable articles.

An improved DVD dispensing machine is disclosed in commonly owned U.S. Pat. No. 7,234,609, which is herein incorporated by reference in its entirety. The invention of the U.S. Pat. No. 7,234,609 and the present invention can function as a DVD dispensing machine-based distribution system that will typically have multiple units of each new release per DVD dispensing machine. The dispensing machines of the U.S. Pat. No. 7,234,609 and the present invention can stock up to two thousand DVDs (movies, games or other entertainment content), making the system competitive with existing brick-and-mortar video rental superstores.

The dispensing machine and system of the U.S. Pat. No. 7,234,609 and the present invention distinguishes itself from such stores by offering major benefits not conventionally offered by such stores, including additional cross-marketing programs (e.g., promotional rentals for a certain amount of dollars spent at the hosting store) and convenience (e.g., open always).

The dispensing machine of the U.S. Pat. No. 7,234,609 and the present invention yields a competitive advantage in the DVD rental marketplace by offering consumers cross-marketing/promotional programs, convenience of selection (e.g., computer-based searches for movies and recommendations based on consumer profiles), and potentially extended hours. The present invention employs a more cost-effective, convenient platform than brick-and-mortar stores. In addition, with the present invention, DVD dispensing machines can be situated in hosting locations having high foot traffic, such as at a popular grocery store, restaurant, drug store, and/or other popular hosting locations.

The dispensing machine of the U.S. Pat. No. 7,234,609 and the present invention can be operated at a substantial savings over the costs associated with traditional brick-and-mortar video rental stores. For example, the present invention does not require hourly employees manning the dispensing machines or restocking them with inventories, due to the ability of the article transport storage units to be delivered to/picked up from host locations by third-party delivery services, such as traditional or contracted courier services.

Unlike brick-and-mortar stores, the dispensing machine of the U.S. Pat. No. 7,234,609 and the present invention does not require an on-site store manager because all operational decisions can be made at a centralized location by a management team located remote from the hosting locations. Unlike brick-and-mortar stores, the dispensing machine of the U.S. Pat. No. 7,234,609 and the present invention does not require significant physical space. Unlike brick-and-mortar stores, the dispensing machine of the U.S. Pat. No. 7,234,609 and the present invention has low operating costs because no heating or air conditioning is required for the dispensing machines and they consume a relatively low level of electrical energy. In addition, the dispensing machine of the U.S. Pat. No. 7,234,609 has low maintenance costs and downtime. Furthermore, the dispensing machines disclosed herein may also be situated outdoors and, where necessary, may include heating and/or air conditioning units to accommodate less temperate climates.

The dispensing machine of the U.S. Pat. No. 7,234,609 and the present invention addresses the shortcomings of traditional brick-and-mortar stores in a convenient and cost-effective delivery vehicle having the added bonus of serving as an effective promotional platform that drives incremental sales to hosting locations. In addition, the dispensing machine of the U.S. Pat. No. 7,234,609 and the present invention overcomes these disadvantages by at least offering more new releases and older selections for any given time period, and lower cost per viewing with significantly more convenience than Internet-based and pay-per-view services.

The dispensing machine of the U.S. Pat. No. 7,234,609 and the present invention is a fully automated, integrated DVD movie video and video game rental and/or purchase systems. It preferably incorporates robust, secure, scalable software that provides a fully personalized user experience and real-time feedback to hosting locations and advertisers, scalable hardware that leverages existing technologies such as touch screen, focused audio speakers and plasma video monitors, technology utilizing the Internet through a system website, and an article transport storage unit that facilitates the exchange of new DVDs for old DVDs in each machine with virtually no need for human intervention. These technologies and others fill long-felt needs in the art and give advantages over conventional video distribution options. The dispensing machine of the U.S. Pat. No. 7,234,609 and the present invention functions as much as a promotional platform as it does a rental kiosk.

By utilizing the dispensing machines and the fully-interactive, real-time, linked Internet website, consumers can rent one or more DVD movie videos, video games, or other entertainment content directly from dispensing machines as well as indirectly by making a rental reservation through the website for later pickup at a conveniently located machine. These dispensing machines are preferably networked with each other, with the inventory control and/or supply office and with the system website by phone-line, DSL, or other Internet connection at each hosting location. Through this linked network, the rental experience for each consumer can be customized based on a profile for each consumer, such as via personalized home pages and rental screens.

With such DVD dispensing machines, there exists the potential for a customer to attempt to return a DVD other than the DVD that the customer rented and retain the rented DVD for his or her own use. Conventional DVD dispensing machines have used a device such as a code printed on the DVD or the DVD case, which was validated by the dispensing machine, to defeat such attempted fraud. Nevertheless, such conventional validation efforts may be defeated by users who create a photocopy of the authentic label and apply it to the non-authentic DVD or DVD case. Furthermore, such conventional validation systems typically suffered from one of the following drawbacks: they were expensive to implement, they could be readily defeated through duplication, or the device was susceptible to being damaged, thereby resulting in a false rejection of an authentic DVD.

The present invention is directed to DVD dispensing machines, a system and method for authenticating returned DVDs and DVDs or other media storage devices for use in such machines and systems. In one embodiment, the system employs a DVD having a security feature such as a code that cannot be copied by a standard photocopier. The DVD has an encrypted authentication code, such as a data matrix code applied as a first layer in a carbon-containing ink. A second layer overtop of and concealing the authentication code may be a black square applied in substantially carbon free ink, such that the naked eye sees only the black square, not the underlying authentication code. When the customer returns the DVD, the article dispensing machine exposes the DVD surface to infrared light, thereby enabling the dispensing machine to read the underlying authentication code. The system overcomes many of the drawbacks of conventional authentication systems in that it is inexpensive to implement, it cannot be defeated through simple means for duplication of a label and it is robust, at least because the system is not prone to false rejections of authentic DVDs. Other features and advantages are provided by the following description and drawings.

DETAILED DESCRIPTION OF THE INVENTION

Figure 1:
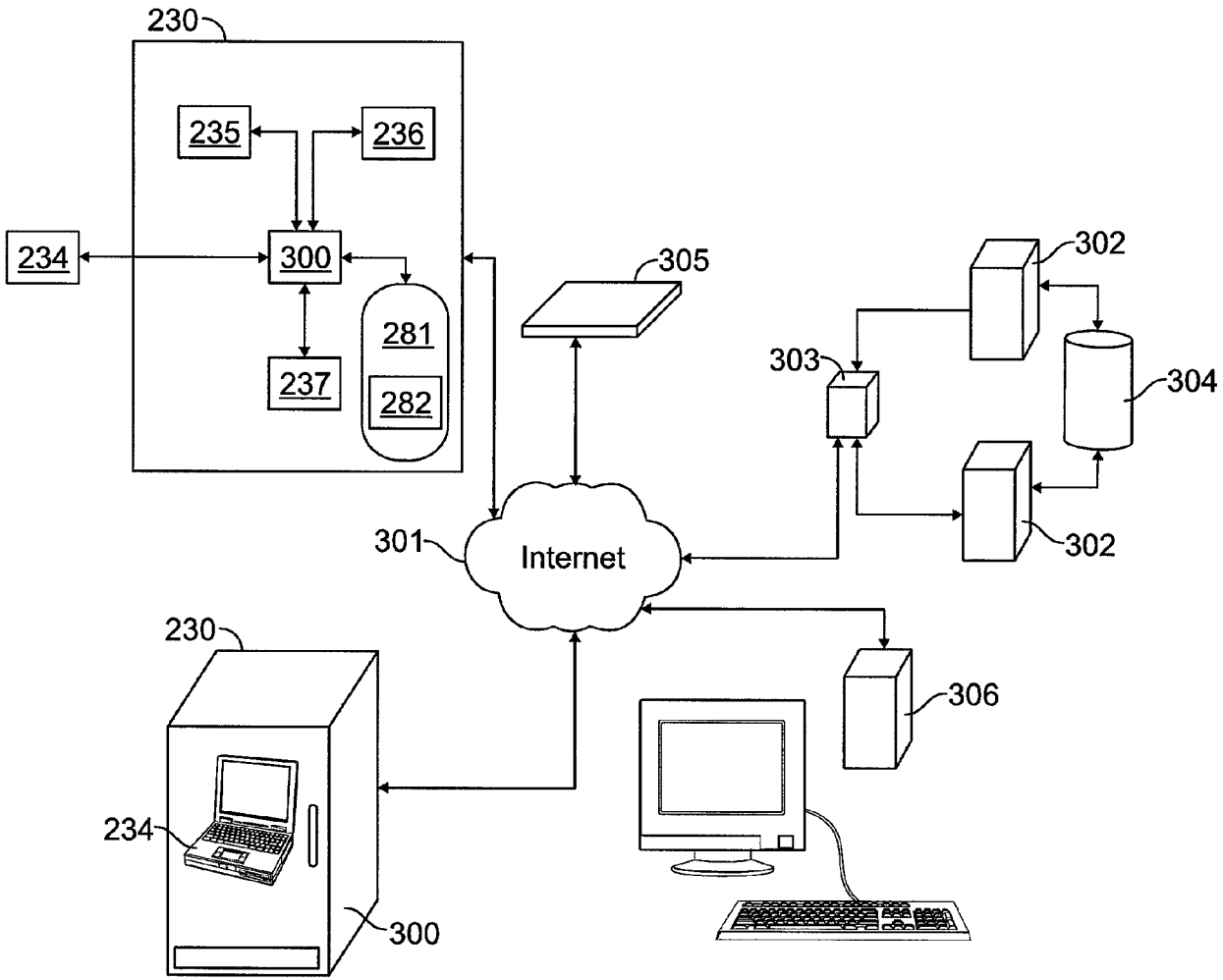
FIG. 1 is an illustration of a system for communicating and processing information in a network of article dispending machines and dispensing apparatus.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
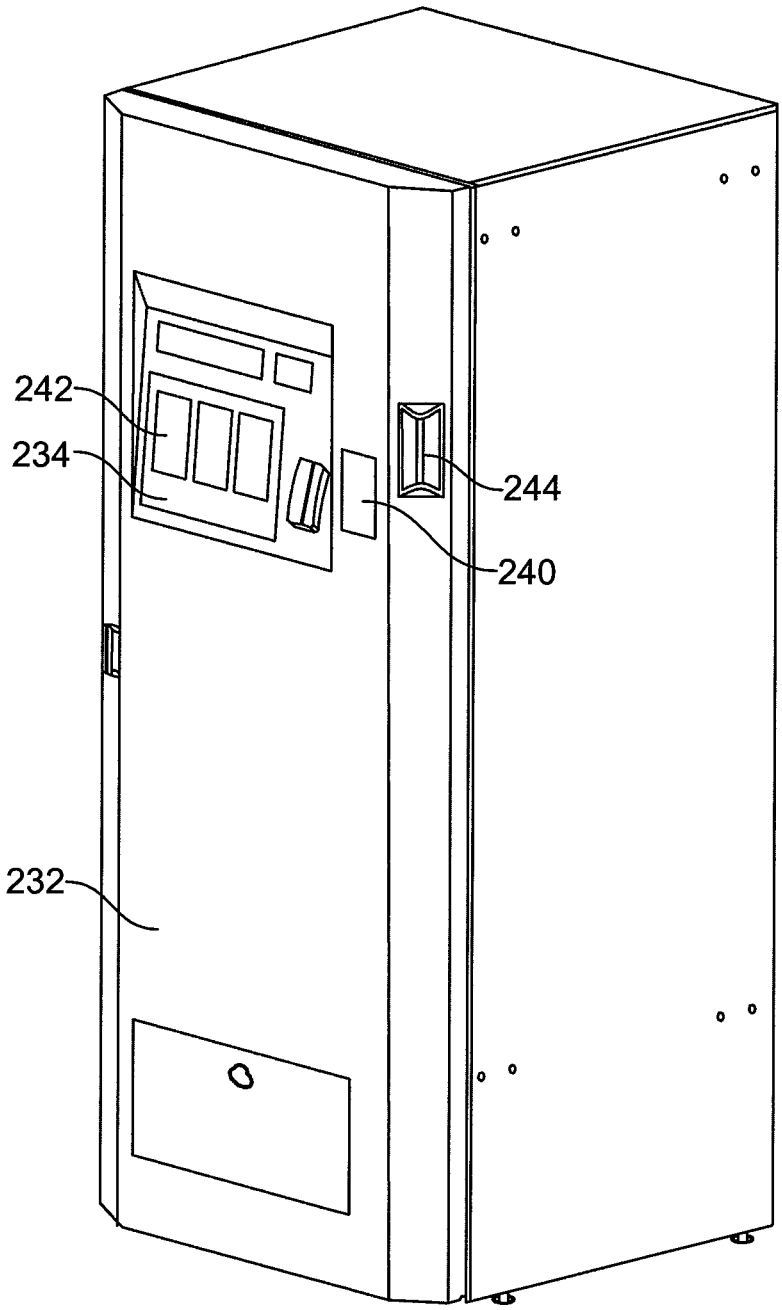
FIG. 2 is a perspective view of an article dispensing machine constructed in accordance with the principles of the present invention.
Figure 3:
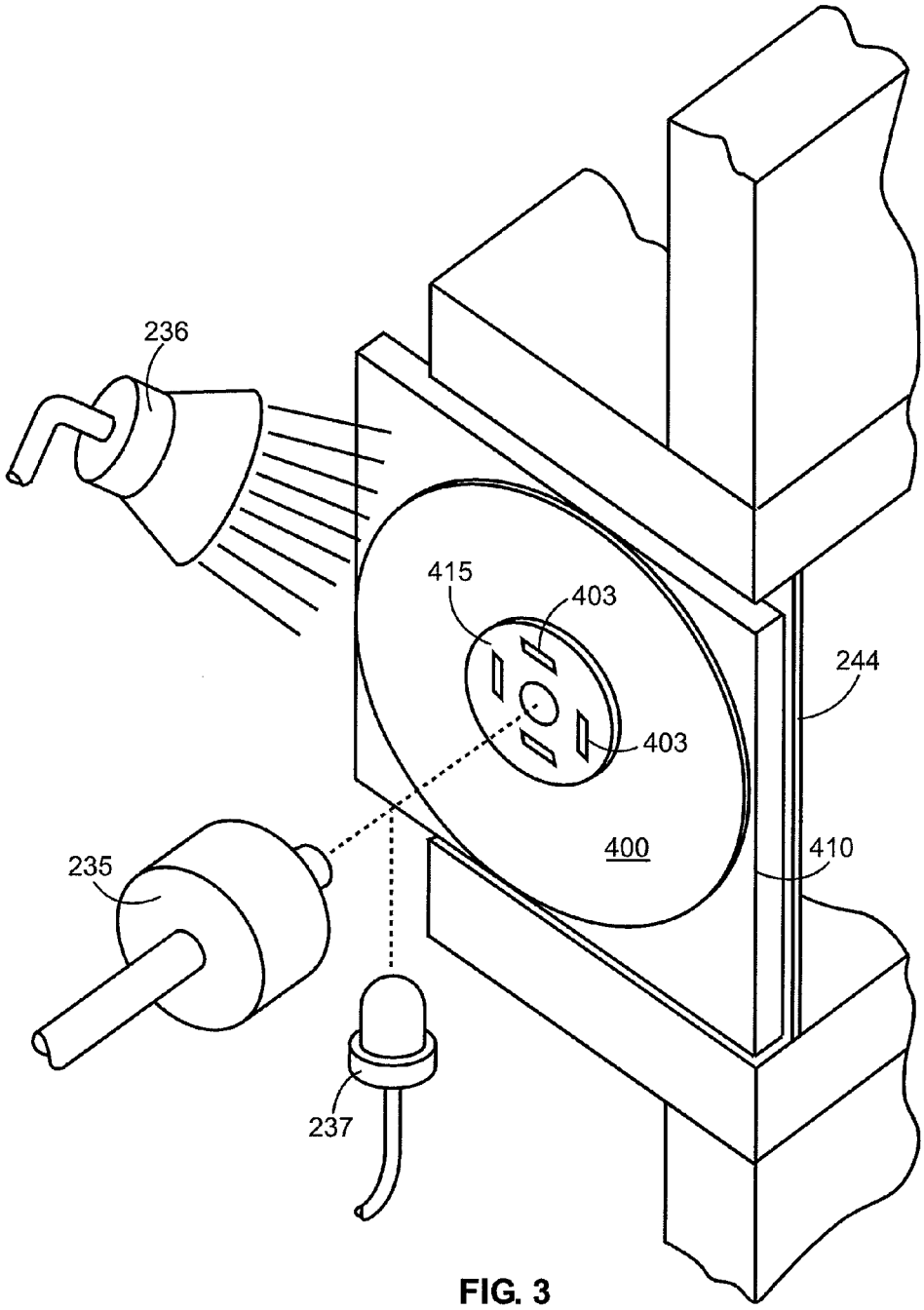
FIG. 3 is a partially open perspective view of a portion of the article dispensing machine of FIG. 2 with certain elements removed for clarity.

FIGS. 1-3 illustrate an article dispensing machine designated 230. Article dispensing machine 230 may be one of a plurality of article dispensing machines included within an article distribution system having a plurality of such machines situated at a plurality of hosting locations. The article dispensing machines of a particular article distribution system preferably form a network. As such, those machines are preferably in communication with each other and/or with a central server or central controller.

As shown in FIG. 1, each article dispensing machine 230 includes a dispensing machine processor 300, also referred to herein as a vending controller, which is connected to a user interface control system 234, an image capture device 235, an infrared light source 236 and, preferably, an article sensor 237, collectively referred to as "the peripheral devices." The processor 300 is capable of executing various programs to provide input to and/or receive outputs from the peripheral devices. Suitable processors for such use are known to those of skill in the art. In addition, the processor is operably connected to at least one memory storage device 281, such as a hard-drive or flash-drive or other suitable memory storage device.

Article dispensing machine memory storage device 281 can include any one or a combination of volatile memory elements (e.g., random access memory (RAM, such as DRAM, SRAM, SDRAM, etc.)) and nonvolatile memory elements (e.g., ROM, hard drive, tape, CDROM, etc.). Moreover, article dispensing machine memory storage device 281 may incorporate electronic, magnetic, optical, and/or other types of storage media. Article dispensing machine memory storage device 281 can have a distributed architecture where various components are situated remote from one another, but are still accessed by processor. Article dispensing machine memory storage device includes an article dispensing machine database 282.

The article dispensing machines 230 preferably comprise a network of machines in communication with one another. As shown in FIG. 1, in the preferred configuration, the article dispensing machines 230 are networked with one another via a central server or central controller 302 in a hub-and-spoke system. However, optionally, the article dispensing machines may be connected and communicate directly with one another, and/or subsets of article dispensing machines may communicate with one another directly as well as with the central server 302.

Generally, in terms of hardware architecture, the central server 302 includes a central processor and/or controller, central memory, and one or more input and/or output (I/O) devices (or peripherals) that are communicatively coupled via a local interface. The architecture of the central server is set forth in greater detail in U.S. Pat. No. 7,234,609, the contents of which are incorporated herein by reference. Numerous variations of the architecture of the central server can be understood by one of skill in the art and are encompassed within the scope of the present invention.

Steps and/or elements, and/or portions thereof of the system and method may be implemented using a source program, executable program (object code), script, or any other entity comprising a set of instructions to be performed. When a source program, the program needs to be translated via a compiler, assembler, interpreter, or the like, which may or may not be included within the memory, so as to operate properly in connection with the operating system (O/S). Furthermore, the software embodying the present system and method can be written as (a) an object oriented programming language, which has classes of data and methods, or (b) a procedural programming language, which has routines, subroutines, and/or functions, for example but not limited to, C, C++, Pascal, Basic, Fortran, Cobol, Perl, Java, and Ada. frequency (RF) or other transceiver, a telephonic interface, a bridge, and a router.

When article dispensing machine 230 is in operation, the article dispensing machine processor is configured to execute software stored within article dispensing machine memory, to communicate data to and from the dispensing machine memory, and to generally control operations of article dispensing machine pursuant to the software. The software aspects of the present invention and the O/S, in whole or in part, but typically the latter, are read by processor, perhaps buffered within the processor, and then executed.

When the present system and method, or aspects thereof, are implemented in software, it should be noted that the software can be stored on any computer readable medium for use by or in connection with any computer related system or method. In the context of this document, a computer readable medium is an electronic, magnetic, optical, or other physical device or means that can contain or store a computer program for use by or in connection with a computer related system or method. The present invention can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device. The computer readable medium can be for example, but not limited to, an electronic, magnetic, optical, electromagnetic, infrared, or semiconductor system, apparatus, device, or propagation medium. More specific examples (a non-exhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via, for instance, optical scanning of the paper or other medium, then compiled, interpreted or otherwise processed in a suitable manner if necessary, and then stored in a computer memory.

For communication with the central server 302, article dispensing machine 230 is equipped with network communication equipment and circuitry. In a preferred embodiment, the network communication equipment includes a network card such as an Ethernet card. In a preferred network environment, each of the plurality of article dispensing machines 230 on the network is configured to use the TCP/IP protocol to communicate via the network 301. It will be understood, however, that a variety of network protocols can also be employed, such as IPX/SPX, Netware, PPP and others. It will also be understood that while a preferred embodiment of the present invention is for article dispensing machine 230 to have a "broadband" connection to the network 301, the principles of the present invention are also practicable with a dialup connection using a standard modem. Wireless network connections are also contemplated, such as wireless Ethernet, satellite, infrared and radio frequency networks.

The central controller 302 communicates with the article dispensing machine controllers 300 via the network 301. The central controller 302 is preferably located at a central station or office that is remote from the plurality of article dispensing machines 230. The central controller 302 can operate as the server for communicating over the network 301 between the plurality of article dispensing machines 230. The central controller 302 receives communications and information from the article dispensing machines 230, and also transmits communications and information to the machines 230. For example, when a DVD rental transaction is performed at the article dispensing machine 230, transaction data such as the rented DVD title is then transmitted from the machine 230 to the central controller 302 via the network 301. It will be understood that central servers in general, such as the central controller 302, are often distributed. A plurality of central servers/controllers 302 may optionally be arranged in "load balanced" architecture to improve the speed and efficiency of the network. To accomplish the implementation of multiple controllers 302, the controllers 302 may be in communication with a router/distributor 303.

The central controller 302 is also in communication with a central database 304. The central database 304 stores information regarding the transaction network. For example, the central database 304 stores data regarding the vending inventory at each of the plurality of article dispensing machines 230. The central database 304 also stores sales information regarding the sales quantities of the vending merchandise stored in the machines 230. For example, the central database 304 stores information regarding the sales totals for each DVD title and for each machine 230 vending location. Central database 304 also stores user information and rental transaction information, such as user IDs, PINs, the date on which DVDs are due to be returned, and the date on which DVDs were rented from the machines 230. Some of this information is also preferably stored in article dispensing machine database 282. The central database 304 may also store a master inventory list of the DVDs housed in each of the dispensing machines.

Central database 304 is preferably a relational database, although other types of database architectures may be used without departing from the principles of the present invention. For example, database 304 may be a SQL database, an Access database or an Oracle database, and in any such embodiment have the functionality stored herein. Central database 304 is also preferably capable of being shared, as illustrated, between a plurality of central controllers 302 and its information is also preferably capable of being transmitted via network 301. It will be understood that a variety of methods exist for serving the information stored in central database 304. In a preferred embodiment, .net and Microsoft Reporting Services are employed, however, other technologies such as ODBC, MySQL, CFML and the like may be used.

The central controller 302 and central database 304 are also preferably accessible by a personal computer 306. The personal computer 306 will be understood as comprising hardware and software consistent with marketable personal computers, such as a display monitor, a keyboard, a pointing device, and a microprocessor with memory. The personal computer also comprises Internet browser software such as Firefox or Internet Explorer. Using the browser software, a user at the personal computer 306 can access a web interface through the central controller 302. To that end, central controller 302 preferably comprises web server software such as IIS or Apache. It will be understood that a variety of web server software and web browser software exists to implement the principles of the present invention without departing therefrom. Through the web browser software, the personal computer 306 communicates with the central controller 302 and allows the user to login to a central command functionality of the central controller 302 and to view and modify data stored in the central database 304. The browser interface also allows the user to perform certain system functions, which will affect the inventory and behavior of the article dispensing machines 230.

In a preferred embodiment, a financial server 305 is also in communication with the network 301. It will be understood that a variety of financial services exist for processing financial information via the Internet and other networks 301. Those services allow for the processing of credit card and debit card information, so that users of the services do not have to interface directly with credit and debit card companies. In FIG. 1, the financial server 305 is illustrated as a single server, although the financial server 305 may comprise an entire sub-network of financial servers 305 responsible for processing financial information.

As shown in FIG. 2, article dispensing machine 230 includes a machine housing 232 with front, rear, top, bottom and side panels. The machine housing 232 is preferably a combination molded fiberglass and sheet metal cabinet. However, those skilled in the art will appreciate that the housing can be constructed from a variety of other suitable materials and with a variety of other suitable manufacturing techniques.

As shown most clearly in FIG. 2, a user interface portion 234 of housing 232 includes a card reader 240, a keypad and/or touch screen 242 and an article transfer opening 244. The card reader 240 is preferably designed in known fashion to read magnetically encoded membership and/or credit cards for authorizing the distribution of articles of inventory through the article transfer opening 244. Keypad and/or touch screen 242 permits consumers and/or inventory stocking personnel to communicate with the dispensing machine 230 and/or a central office linked in electrical communication with the dispensing machine. Keypad and/or touch screen 242 also permits consumers and/or inventory stocking personnel to enter appropriate commands directed to carrying out specific machine tasks. It will be appreciated that the optional touch screen includes a monitor made with known technologies making it capable of being utilized as a user interface for entry of commands designed to carry out machine tasks.

Furthermore, it will be appreciated that additional user interface portions having additional or even identical user interface components could be incorporated within article dispensing machine 230. For example, these components could be incorporated on other panels of the housing 232 of machine 230 so that the machine can be used simultaneously by multiple consumers, translating into more efficient distribution of articles in high traffic areas.

As shown in FIG. 3, the dispensing machine contains a light source 236, positioned to illuminate a DVD received by the receptacle 244 with electromagnetic radiation of a predetermined wavelength range outside of the visible light spectrum (300 nm to 760 nm). In a preferred embodiment, the light source 236 illuminates the DVD with electromagnetic radiation within the infrared light range (1 mm to 750 nm). The dispensing machine also contains an image capture device 235 positioned to photograph or otherwise capture the image of at least a portion of the surface of the returned DVD. The image capture device is preferably a digital camera, such as a charge coupled device (CCD) camera or a complementary metal oxide semiconductor (CMOS) camera, or a personal computer camera that are configured to capture images in the first predetermined wavelength range as known in the art, such as e.g. an infrared camera. Alternatively, the image capture device could be a constant recording device such as a digital video camera configured to capture images in the first predetermined wavelength range. The image capture device preferably has an automatic focusing feature as is known in the art.

The dispensing machine may further include an article sensor 237 for detecting the presence of an article inserted into the receptacle. The article sensor 237 may be simple mechanical switch, a proximity sensor, a light bar, or any other suitable sensor known in the art for detecting presence. In the preferred embodiment, the article sensor 237 detects the presence of the returned DVD and activates the infrared light source 236. The infrared light source 236 is preferably turned on after the returned DVD has been inserted into the receptacle 244.

Figure 6:
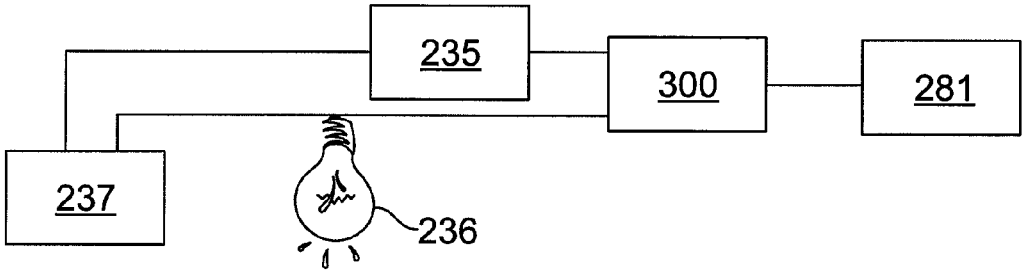
FIG. 6 is a schematic drawing of a first embodiment of portions of an article dispensing machine constructed in accordance with the principles of the present invention.
Figure 7:
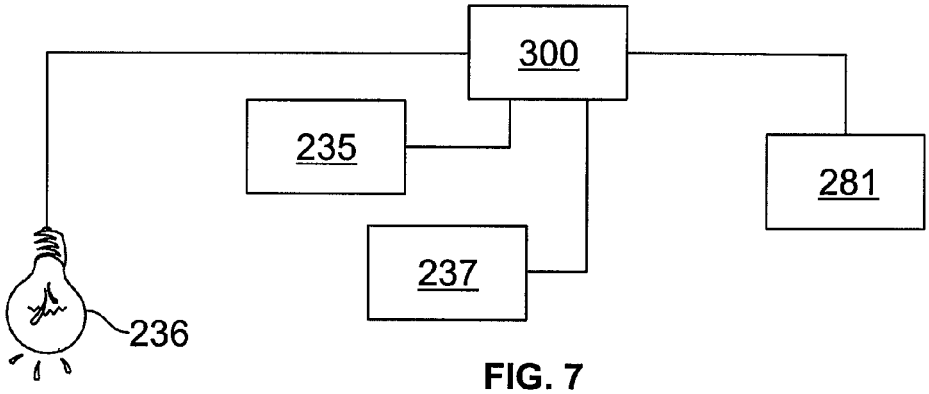
FIG. 7 is a schematic drawing of a second embodiment of portions of an article dispensing machine constructed in accordance with the principles of the present invention.
Figure 8:
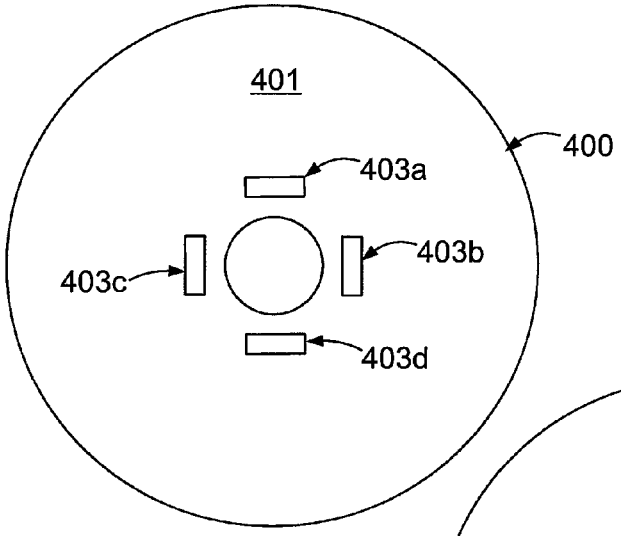
FIG. 8 is a plan view of a DVD in accordance with the principles of the present invention.

FIG. 6 shows a schematic of a portion of the system for authenticating an article, in which the detection of the presence of an article by article sensor 237 directly activates the light source 236. The triggering of the sensor may directly activate the light source 236 or, as shown in schematic FIG. 7, the signal may be sent to the processor 300, which activates the light source 236.

Alternatively, the light source 236 could be activated by the initiation of the return process by the consumer. For example, the user-selection of a "Return" option via the user interface may cause the processor to activate the infrared light source 236. Yet, alternatively, the light source could constantly be on whenever the machine has power.

Figure 4:
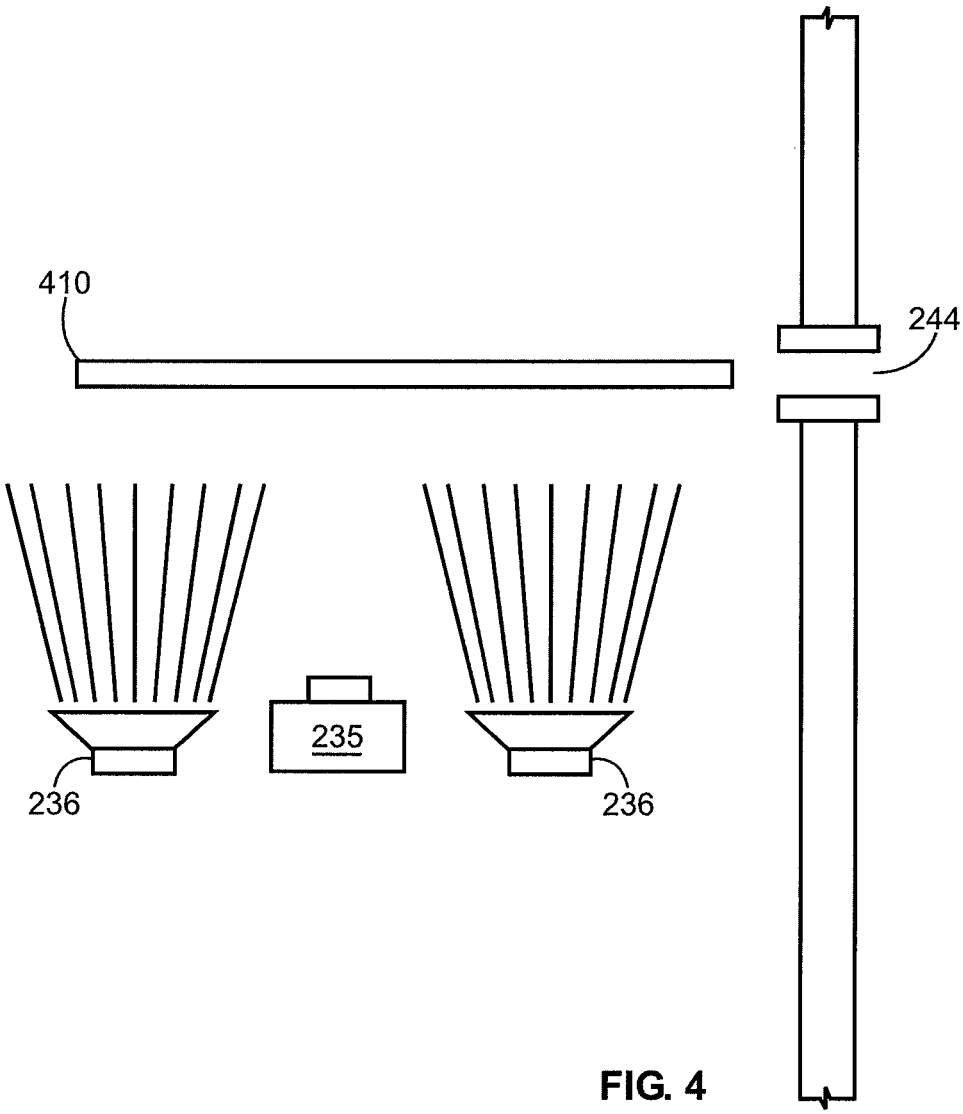
FIG. 4 is a plan view of the portion of the article dispensing machine of FIG. 3.
Figure 9:
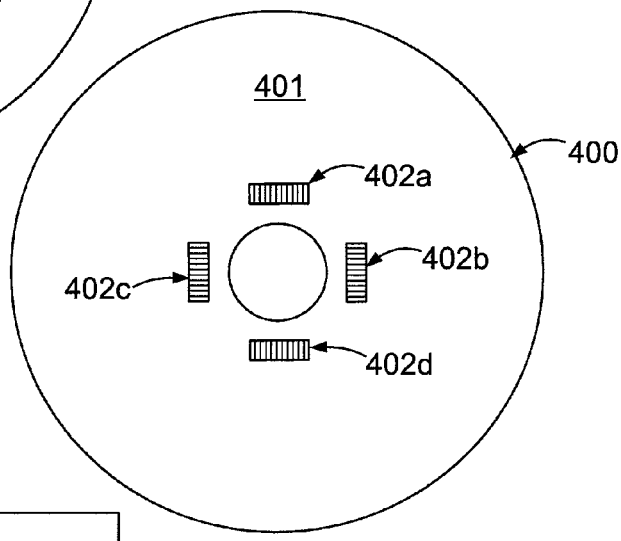
FIG. 9 is a plan view of the DVD in FIG. 8 when exposed to a first predetermined wavelength of electromagnetic radiation.
Figure 10:
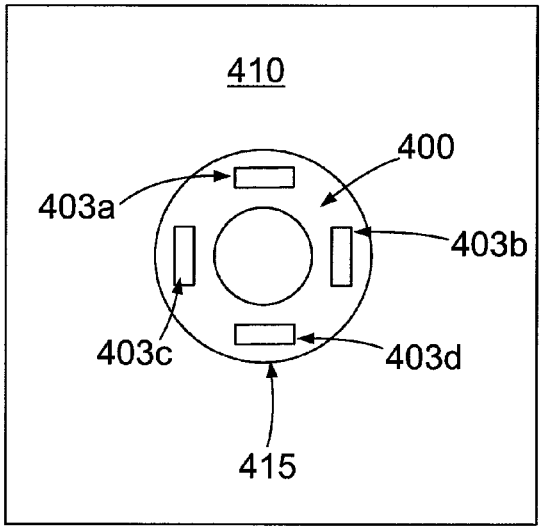
FIG. 10 is a plan view of the DVD of FIG. 8 housed in a case.

As shown in FIGS. 3 and 4, the light source 236 is positioned to illuminate a first surface 401 of the returned DVD with infrared light. FIG. 9 shows a first surface 401 of the DVD 400. The first surface has a machine-readable authentication code 402, which is substantially visible when exposed to the first predetermined wavelength and forming a first layer. In a preferred embodiment, in which the light source 236 provides infra red light, the machine-readable authentication code 402 may be a carbon containing ink, which, when exposed to infrared light, is visible. As shown in FIG. 9, the authentication code 402 is preferably a data matrix that represents an alpha-numeric sequence. However, the authentication code could be a bar code, numerical or binary sequence or any other symbol. The authentication code is preferably printed on the first surface of the DVD in a plurality of locations 402 *a, b, c, d* to increase the ease of reading the authentication code and to allow the authentication code to be read even if one of the authentication codes is damaged. The authentication code may also be printed to a label affixed to the first surface of the DVD. The authentication code may comprise toner imaged onto the DVD via electron beam or ion deposition techniques, electrophotographic or electrographic methods or via ink jet. As shown in FIG. 10, in a preferred embodiment, the DVD is contained within a case 410 having an opening 415 aligned with the location of the authentication code or codes 402, so that the authentication codes are not concealed by the DVD case. Alternatively, the DVD case could include a transparent section aligned with the authentication code thereby allowing the authentication code to be viewed through the DVD case.

FIG. 9 shows the first surface of DVD 400 as it appears in visible light. A second layer 403 is applied in a medium that is substantially opaque in visible light, but substantially transparent when exposed to the first predetermined wave-length of electromagnetic radiation. For example, in the preferred embodiment, the second layer is preferably a substantially carbon free ink, which is applied overtop of and at least partially concealing the authentication codes. Preferably, the second layers 403 *a, b, c*, and *d* are solid geometric shapes that entirely cover and conceal the authentication codes that form the first layers. The second layers are preferably printed in black ink or another color of ink sufficiently opaque when viewed in white light. The substantially carbon free ink shapes conceal the authentication codes 402*a-d* and prevent them from being viewed by the naked eye in white light or from being copied by a standard photocopying machine. When the first surface 401 of DVD 400 is exposed to infrared light, the carbon-containing authentication codes are visible through the second layers, which are sufficiently transparent in infrared light. The second layers may be applied by litho or flexographic techniques, or by ink jet, electrophotographic or electrographic methods.

Turning now to the functioning of the machine during a consumer transaction, as a consumer approaches an article dispensing machine, the consumer observes the display monitor and the user interface 234. The consumer may also observe a plasma/LCD monitor displaying marketing information, or a lightbox containing marketing information for branding the vending apparatus 230. The consumer then enters the appropriate commands at the user interface control 234 associated with the dispensing machine to select a DVD to be dispensed by the machine. The user interface can employ simple menus and a fixed set of keys for consumers to make their selections, it can employ break-resistant touch screens, or it can employ a combination of both. Once a selection has been made, the consumer then merely inserts a card, such as a credit card, into the card reader 240 positioned at the front of the dispensing machine 230 and, in response, the machine will dispense the selected DVD without the need for further input by the consumer.

Figure 5:
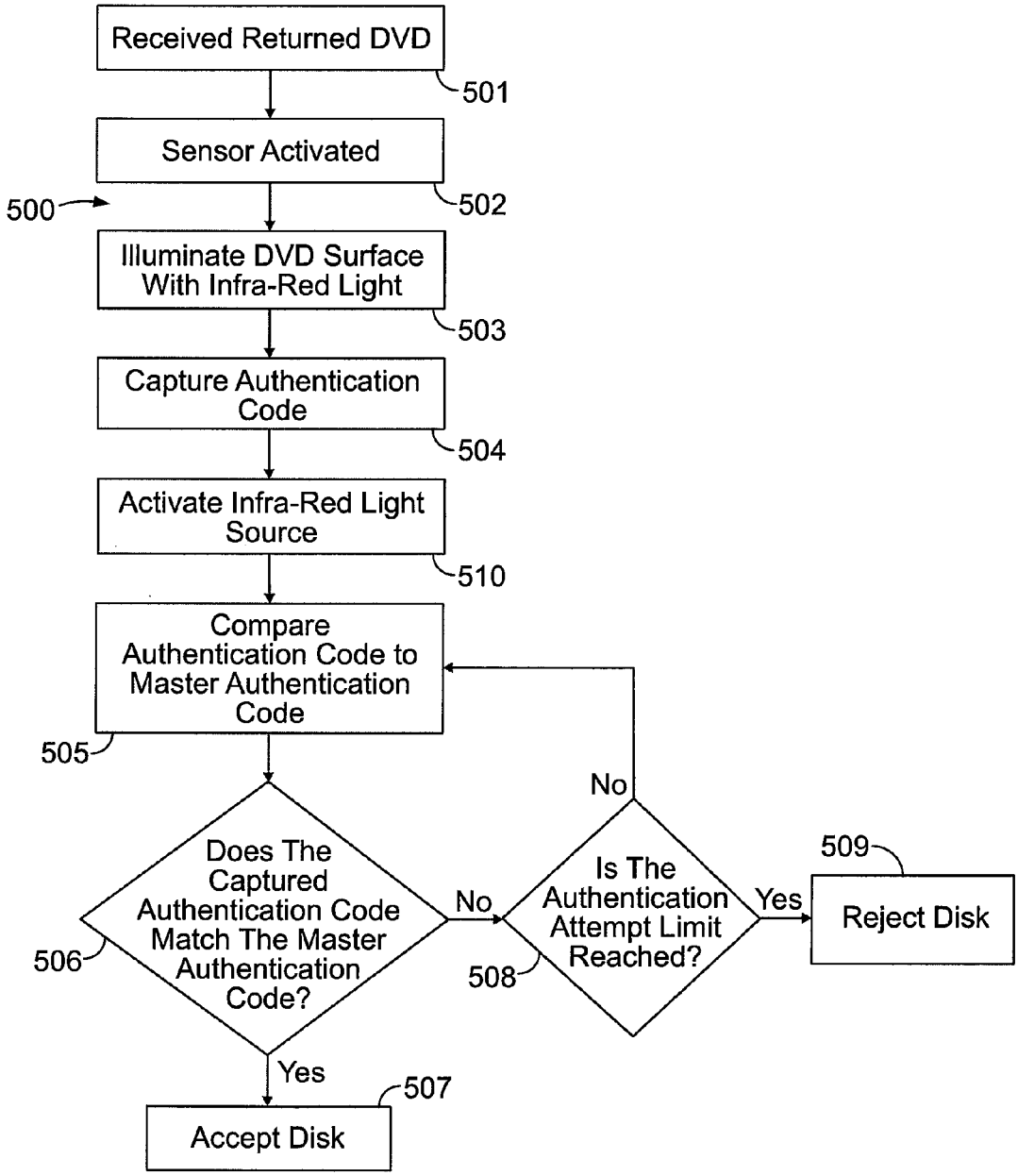
FIG. 5 is a flowchart illustrating an order of operations performed by an article dispensing machine for authenticating a returned article.

FIG. 5 shows a process 500 for authenticating a returned DVD. The consumer may initiate the return process via the user interface 234, for example by selecting the option "RETURN A DISK" on a touchscreen. The consumer then inserts the DVD into the dispensing/receiving receptacle 244, which may be an opening in the front panel of the machine, and the DVD is received by the article vending machine through the opening as illustrated by step 501.

Once the DVD is inserted in the article transfer opening 244, optionally, sensor 237 is triggered by the receipt of the DVD as shown in step 502. The surface of the DVD is illuminated by the infrared light source 236, as shown in step 503. Then, image capture device 235 is activated and captures the image of at least a portion of the first surface 401 of the DVD, including the authentication code as shown in step 504. The image capture device 235 captures the image of the authentication code and converts it to a digital file. The image capture device 235 may capture a series of images of the authentication code in rapid succession, or, in the case of a digital video camera, may take a continuous video of the authentication code. The image capture device may further capture the image of the authentication code from multiple locations on the DVD 402 *a, b, c*, and *d*. The digital file or files are then transmitted to the processor 300 where the authentication code is read from the digital file and compared to a pre-programmed or "master" authentication code as shown in steps 505-506.

If the authentication code matches the master authentication code, the disk is authenticated and the processor continues the return process as shown in step 507. If the authentication code cannot be read or does not match the master authentication code, the processor may be programmed to attempt to read the authentication code from a subsequently transmitted digital file. This process may repeat the steps of reading 505 and comparison 506 for a predetermined number of digital files or a predetermined time period, referred to herein as the authentication attempt limit as shown in step 508. If the authentication attempt limit has been reached and the authentication code has not been authenticated, the authentication process is terminated and the DVD is rejected 509. The rejected DVD may be ejected from the receptacle 244 for return to the user and the user interface may display a message to the consumer that the disk could not be authenticated.

Alternatively, the rejected DVD may be retained by the article dispensing machine and quarantined. The DVD may be quarantined by being physically transferred to a separate holding area contained within the machine. Preferably, the DVD is quarantined by designating the DVD as not to be vended or "inoperable" in the article dispensing machine database 282. DVDs marked as "inoperable" may be stored with the other inventory in an open storage slot 369 in the vending machine.

In the embodiments in which the infrared light source is activated each time a DVD is returned (instead of remaining on when the machine has power), the infrared light source 236 and the image capture device 235 may be set to be deactivated after a predetermined time period as shown in step 510. In the preferred embodiment, the infrared light source and the image capture device are activated for three to four seconds. Alternatively, the processor 300 may be configured to deactivate the image capture device and infrared light source after the authentication code encryption has successfully been authenticated or after the authentication attempt limit has been reached.

In the preferred embodiment, the first surface of the DVD 401, in addition to having an authentication code thereon, also includes an article identifier. The article identifier is preferably a bar code that encodes a serial number uniquely assigned to the DVD, but may also be a data matrix or alphanumeric sequence or the like. The article identifier is printed on the first surface of the DVD in a carbon-containing ink, thereby enabling the article identifier to be viewed and photographed or otherwise captured in infrared light, and eliminating the need for a second light source. The image capture device may also captures the article identifier at the same time that the authentication code is captured by the image capture device. Thus, the digital images transferred to the processor contain both the authentication code and the article identifier. However, in an alternate embodiment, the article identifier and the authentication code may be captured and/or transferred separately.

After the DVD has been authenticated by the processor (or concurrently with the authentication process) the article identifier is read from the digital image. The article identifier is then used to identify the returned DVD during the return and restocking process and is used to update an article dispensing machine inventory database. The article identifier may further be used in the billing process to identify the rented article that the customer has returned and to calculate the charge for the rental, the details of which are set forth in U.S. Pat. No. 7,234,609, the contents of which are herein incorporated by reference in their entirety.

In certain embodiments, the article identifier and the authentication code may both be components of a single device, for example a data matrix in which a first section of the data matrix represents the authentication code and a second section represents the article identifier.

Any process descriptions or blocks in figures represented in the figures should be understood as representing modules, segments, or portions of code which include one or more executable instructions for implementing specific logical functions or steps in the process, and alternate implementations are included within the scope of the embodiments of the present invention in which functions may be executed out of order from that shown or discussed, including substantially concurrently or in reverse order, depending on the functionality involved, as would be understood by those having ordinary skill in the art.

While the specific embodiments have been illustrated and described, numerous modifications come to mind without significantly departing from the spirit of the invention, and the scope of protection is only limited by the scope of the accompanying Claims.

What is claimed is:

1. An article rental machine for authenticating a returned article comprising a machine-readable authentication code forming a first layer on a surface of the returned article, and a second layer substantially opaque in visible light and at least partially overlaying the authentication code, the article rental machine comprising:

a receptacle for receiving the returned article;

an infrared light source configured to illuminate the surface of the returned article with electromagnetic radiation in an infrared spectrum;

an article sensor in communication with the infrared light source, wherein the article sensor detects a presence of the returned article and causes the infrared light source to illuminate;

an image capture device configured to capture a digital image of the authentication code while the surface of the returned article is illuminated, wherein the authentication code is comprised of a carbon-containing ink visible in the infrared spectrum, and the second layer is comprised of a substantially carbon-free ink; and a processor in communication with the image capture device, wherein the processor is configured to identify the authentication code from the digital image and to compare the authentication code to a master authentication code.

2. The article rental machine of claim 1, wherein the digital image is stored in a digital file, and wherein the processor identifies the authentication code from the digital file.

3. The article rental machine of claim 1, wherein the article sensor is in communication with the processor and detection of the presence of the returned article causes the article sensor to send an article presence signal to the processor.

4. The article rental machine of claim 3, wherein the processor is in communication with the infrared light source and receipt of the article presence signal by the processor causes the processor to turn on the infrared light source and activate the image capture device to capture the digital image of the authentication code.

5. The article rental machine of claim 1, wherein the article sensor is in communication with the image capture device and detection of the presence of the returned article by the article sensor causes the image capture device to capture the digital image of the authentication code.

6. The article rental machine of claim 1, wherein the authentication code is a data matrix.

7. A method for authenticating a returned article at an article rental machine, the returned article comprising a machine-readable authentication code forming a first layer on a surface of the returned article, and a second layer substantially opaque in visible light and at least partially overlaying the authentication code, the article rental machine comprising a receptacle, an article sensor, an infrared light source, an image capture device, and a processor, the method comprising the steps of:

detecting a presence of the returned article via the article sensor;

responsive to detecting the presence, illuminating the surface of the returned article with electromagnetic radiation in an infrared spectrum via the infrared light source;

while the surface of the returned article is illuminated, capturing an image of the authentication code on the surface of the returned article with the image capture device to create a captured image, wherein the authentication code is comprised of a carbon-containing ink visible in the infrared spectrum, and the second layer is comprised of a substantially carbon-free ink;

reading, by the processor, the authentication code from the captured image; and authenticating the authentication code.

8. The method of claim 7, further comprising the step of decoding the authentication code.

9. The method of claim 7, wherein the captured image is at least one of digital data representing the captured image or a digital file.

10. The method of claim 7, further comprising the step of sending a signal from the article sensor to the infrared light source and the image capture device to respectively activate the infrared light source and the image capture device.

11. The method of claim 10, further comprising the step of turning off the infrared light source and the image capture device after a predetermined time interval.

12. The method of claim 7, further comprising the steps of:

sending a first signal from the article sensor to the processor indicating the presence of the returned article; and sending a second signal from the processor to the infrared light source and the image capture device to respectively activate the infrared light source and the image capture device.

13. The method of claim 12, further comprising the step of turning off the infrared light source and the image capture device after a predetermined time interval.

14. The method of claim 13, further comprising the step of turning off the infrared light source and the image capture device after a predetermined number of images have been captured.

15. The method of claim 12, further comprising the step of turning off the infrared light source and the image capture device after one of:

authenticating the authentication code, or reaching a predetermined time interval.

16. A method for receiving a returned article at an article rental machine, the returned article comprising an authentication code forming a first layer on a surface of the returned article, a second layer substantially opaque in visible light and at least partially overlaying the authentication code, and an article identifier, the article rental machine comprising an opening, an article sensor, an infrared light source, an image capture device, and a processor, the method comprising the steps of:

detecting a presence of the returned article via the article sensor;

responsive to detecting the presence, illuminating the surface of the returned article with radiation in an infrared spectrum via the infrared light source;

while the surface of the retruned article is illuminated, capturing an image of the authentication code and the article identifier on the surface of the returned article with the image capture device to create a captured image, wherein the authentication code is comprised of a carbon-containing ink visible in the infrared spectrum and the second layer is comprised of a substantially carbon-free ink;

reading, by the processor, the authentication code and the article identifier from the captured image; and authenticating the authentication code.

17. The method of claim 16, wherein the article identifier is a serial number that identifies the returned article.

18. The method of claim 16, wherein the captured image is at least one of digital data representing the captured image or a digital file.

19. The method of claim 16, wherein the article identifier is printed in the carbon-containing ink.

* * * * *